United States Patent [19]

Saito et al.

[11] 4,124,011

[45] Nov. 7, 1978

[54] SYSTEM FOR PREVENTING OUTFLOW OF OIL FROM AN OIL FILLER PORT

[75] Inventors: Taiji Saito; Masafumi Matsuoka, both of Toyota, Japan

[73] Assignee: Toyota Jidosha Kogyo Kabushiki Kaisha, Tokyo, Japan

[21] Appl. No.: 812,678

[22] Filed: Jul. 5, 1977

[30] Foreign Application Priority Data

Apr. 21, 1977 [JP] Japan ..... 52-46250

[51] Int. Cl.[2] ..... F01P 1/02; F01P 1/10

[52] U.S. Cl. ..... 123/195 C; 123/90.38; 123/90.37; 184/1.5

[58] Field of Search ..... 123/195 C, 90.38, 90.37, 123/90.33, 90.27, 196 R; 184/1.5, 6

[56] References Cited

U.S. PATENT DOCUMENTS 3,422,806 1/1969 Lorean ..... 123/90.38

3,521,726 7/1970 Freyn ..... 123/195 C 3,530,840 9/1970 Freyn ..... 123/195 C

*Primary Examiner*—Ronald H. Lazarus

*Attorney, Agent, or Firm*—Stevens, Davis, Miller & Mosher

[57] ABSTRACT

A system for preventing outflow of oil from an oil filler port of an overhead camshaft engine. The system comprises a partition wall extending downwardly from a cylinder head cover to divide the interior thereof into a timing chain chamber having a timing chain gear and a timing chain and a valve chamber having the oil filler port, a cam shaft and intake and exhaust valves. The partition wall prevents lubricating oil splashed in the timing chain chamber by rotation of the timing chain from getting into the valve chamber, and thereby prevents outflow of lubricating oil through the oil filler port.

4 Claims, 4 Drawing Figures

SYSTEM FOR PREVENTING OUTFLOW OF OIL FROM AN OIL FILLER PORT

The present invention relates to a system for preventing outflow of lubricating oil from an oil filler port provided in a cylinder head cover of an overhead camshaft engine.

In a conventional overhead camshaft engine of an automobile, a cam shaft is provided in the upper portion of a cylinder head for operation of intake and exhaust valves. A timing chain gear is mounted to the forward end of the cam shaft, and a timing chain passes around the timing chain gear and a driving gear fixed to a crank shaft. In general, an oil filler port is provided in the forward portion of a cover of the cylinder head to facilitate feeding of oil, and thus the oil filler port is positioned close to the timing chain. In operation, therefore, lubricating oil for the cam shaft is splashed in the vicinity of the oil filler port by rotation of the timing chain driven by the timing chain gear of the crank shaft. Lubricating oil thus splashed makes outflow from the oil filler port when the oil filler port is left open or the oil filler cap comes loose and slips off.

To prevent such outflow of oil from the oil filler port, a shield has been provided integrally with the cylinder head cover to form the bottom surface of the oil filler port with a small opening allowing feeding of oil. However, it has been impossible to perfectly prevent outflow of oil from the oil filler port.

An object of the present invention is to provide a system for preventing outflow of oil from an oil filler port of an overhead camshaft engine when the oil filler port is left open or the oil filler cap comes loose and slips off.

Another object of the present invention is to provide a system which can prevent fire on an automobile caused by outflow of oil from the oil filler port.

Still another object of the present invention is to provide a system for preventing outflow of oil from an oil filler port of an overhead camshaft engine having a partition wall which works as a radiating fin to lower the temperature of lubricating oil splashed thereon by rotation of a timing chain.

The invention will now be described in further detail by way of example with reference to the accompanying drawings, in which.

Figure 1:
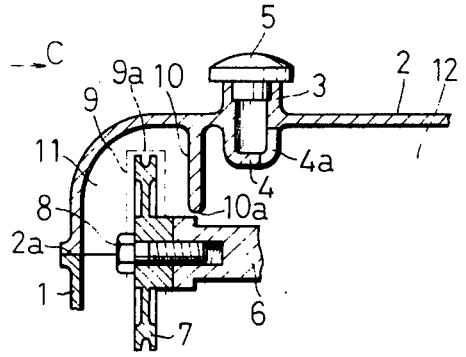
FIG. 1 is a longitudinal sectional view of the forward portion of a cylinder head cover of an overhead camshaft engine in which the system of the present invention is applied.
Figure 2:
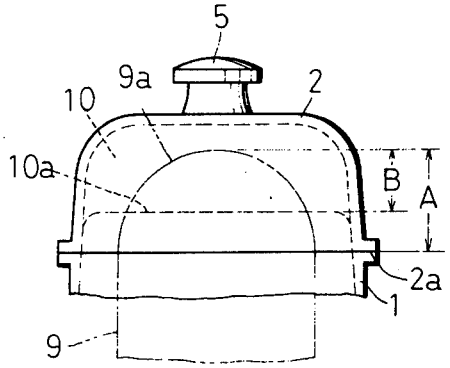
FIG. 2 is a front elevational view shown in the direction of the arrow indicated by C in FIG. 1.

Referring now to FIGS. 1 and 2 of the drawings, there is shown a cylinder head 1 of an overhead camshaft engine on which a cylinder head cover 2 is mounted. In the forward portion of the top of the cylinder head 1, there is provided an oil filler port 3 which is formed integrally with the cylinder head cover 2. The oil filler port 3 is provided with a shield 4 which forms the bottom surface thereof and has a small opening 4*a* that allows feeding of oil. A filler cap 5 is mounted to the oil filler port 3 to prevent outflow of oil therefrom.

In the upper portion of the cylinder head 1, a cam shaft 6 is rotatably mounted by a bearing (not shown) to operate intake and exhaust valves (not shown). A timing chain gear 7 is mounted to the forward end of the cam shaft 6 by a bolt, and a timing chain 9 passes around the timing chain gear 7 and a driving gear (not shown) mounted to a crank shaft (not shown). The timing chain 9 is positioned close to the oil filler port 3 and the opening 4*a* is on the remote side of the shield 4 from the timing chain 9.

According to the present invention, a partition wall 10 extends downwardly from the cylinder head cover 2 between the oil filler port 3 and the timing chain 9. In FIG. 2, A shows the distance between the bottom surface 2*a* of the cylinder head cover 2 and the upper end 9*a* of the timing chain 9 and B shows the distance between the upper end 9*a* of the timing chain 9 and the lower end 10*a* of the partition wall 10. The length of the partition wall 10 is determined such that the ratio of A to B is 1:1 to 2.5:1. The partition wall 10 divides the interior of the cylinder head cover 2 into a timing chain chamber 11 and a valve chamber 12 containing the intake and exhaust valves.

In operation, the timing chain 9 is driven by the driving gear of the crank shaft and causes rotation of the timing chain gear 7 to rotate the cam shaft 6. Lubricating oil is fed through the oil filler port 3 to lubricate the cam shaft 6 and the timing chain 9 and is splashed around the cam shaft and the timing chain 9 by centrifugal force when they are rotated. Lubricating oil splashed by rotation of the timing chain 9 in the timing chain chamber 11 is prevented by the partition wall 10 from getting into the valve chamber 12. Namely, lubricating oil splashed by rotation of the timing chain 9 is prevented by the partition wall 10 from reaching the oil filler port 3. On the other hand, lubricating oil splashed by rotation of the cam shaft 6 is less in amount than that splashed by rotation of the timing chain 9 since the cam shaft 6 is smaller in diameter than the timing chain gear 7 (see FIG. 1). Therefore, lubricating oil splashed by rotation of the cam shaft 6 is prevented by the shield 4 from reaching the oil filler port 3 through the opening 4*a*.

Lubricating oil splashed by other parts such as a rocker arm (not shown) is also prevented by the shield 4 from reaching the oil filler port 3.

The partition wall 10 works as a radiating fin to lower the temperature of lubricating oil which is splashed thereon by rotation of the timing chain 9.

Figure 3:
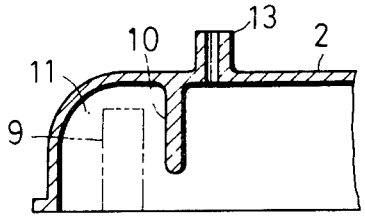
FIG. 3 is a view similar to FIG. 1 in which a by-pass for a blow-bye gas reductor is provided instead of the oil filter port shown in FIG. 1.

In FIG. 3 showing another embodiment of the present invention, there is provided a by-pass 13 for a blow-bye gas reductor (not shown) which is connected to an air cleaner (not shown) instead of the oil filler port 3 shown in FIG. 1.

Figure 4:
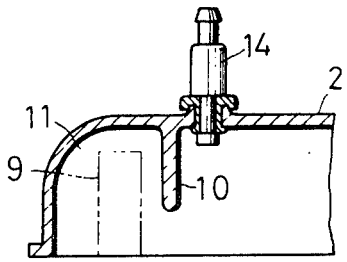
FIG. 4 is a view similar to FIG. 3 in which a main path is provided instead of the by-pass shown in FIG. 3.

In FIG. 4 showing still another embodiment of the present invention, there is provided a main path 14 for a blow-bye gas reductor (not shown) which is connected to an intake manifold (not shown).

In both of the embodiments of FIGS. 3 and 4, no oil shield is usually required under the by-pass 13 or the main path 14 since lubricating oil splashed by rotation of the timing chain 9 is prevented by the partition wall 10 from getting into the valve chamber 12. Even if any such oil shield is to be provided, a simpler one will be sufficient.

While the invention has been described with reference to a few embodiments thereof, it is to be understood that modifications or variations may be easily made without departing from the scope of this invention which is defined by the appended claims.

What is claimed is:

1. In an overhead camshaft engine which includes a cylinder head, a cylinder head cover having a lower end joined to the upper end of said cylinder head intake and exhaust valves and an oil filler port, said oil filler port having a longitudinal axis extending vertically through the top wall of said cover, a horizontally disposed cam shaft provided in the top of said cylinder head and adapted to operate said intake and exhaust valves, a vertically disposed timing chain gear provided at one end of said cam shaft and a timing chain engaged with said timing chain gear, a system for preventing outflow of oil from said oil filter port, said system comprising a vertical partition wall extending downwardly from said cylinder head cover between said timing chain gear and said oil filler port to divide the interior of said cover into a first chamber having said timing chain and a second chamber having said oil filler port and said intake and exhaust valves.

2. The invention as defined in claim 1 wherein said partition wall is integrally formed with the interior surface of said cover and extends across the entire width of said cover.

3. The invention as defined in claim 2 wherein said partition wall has a substantially straight lower edge slightly spaced above said cam shaft.

4. The invention as defined in claim 2 wherein said partition wall has a generally semicircular lower edge encircling said cam shaft and slightly spaced apart therefrom.

* * * * *